US007806155B1

(12) United States Patent
Lee

(10) Patent No.: US 7,806,155 B1
(45) Date of Patent: Oct. 5, 2010

(54) TREATMENT PROCESS FOR LOGS USED IN FURNITURE CONSTRUCTION AND FURNITURE COMPONENTS FORMED FROM SUCH TREATED LOGS

(76) Inventor: Lawrence K. Lee, 9320 Harwin Dr., Houston, TX (US) 77036

( * ) Notice: Subject to any disclaimer, the term of this patent is extended or adjusted under 35 U.S.C. 154(b) by 202 days.

(21) Appl. No.: 11/971,086

(22) Filed: Jan. 8, 2008

Related U.S. Application Data

(63) Continuation-in-part of application No. 11/932,999, filed on Oct. 31, 2007.

(51) Int. Cl.
*B27F 7/00* (2006.01)

(52) U.S. Cl. ..... 144/353; 144/355; 144/360; 144/368; 144/380

(58) Field of Classification Search ..... 144/58, 144/360, 363, 364, 380, 358, 344, 345, 353, 144/355; 52/586.1, 233, 582.1, 585.1, 655.1; 427/325, 291, 297, 393, 393.3, 440
See application file for complete search history.

(56) References Cited

U.S. PATENT DOCUMENTS 1,996,567 A * 4/1935 Butterworth ..... 427/416
2,355,553 A * 8/1944 Owens et al. ..... 144/340
3,992,838 A * 11/1976 Vizziello ..... 52/233
4,044,172 A * 8/1977 Bugg ..... 427/557
4,181,763 A * 1/1980 Shellenberger ..... 428/142
4,233,753 A * 11/1980 Olson ..... 34/405
4,443,990 A * 4/1984 Johnson ..... 52/514
4,787,185 A * 11/1988 Gascho ..... 52/233
4,951,435 A * 8/1990 Beckedorf ..... 52/233
5,020,289 A * 6/1991 Wrightman ..... 52/233
5,665,432 A * 9/1997 Kuwazuru et al. ..... 427/325
6,460,583 B1 * 10/2002 Lindal ..... 144/347

* cited by examiner

*Primary Examiner*—Shelley Self
(74) *Attorney, Agent, or Firm*—Egbert Law Offices PLLC

(57) ABSTRACT

A process for treating wooden logs to prevent cracking and increase durability includes the steps of cutting a longitudinal slot along the length of the log, forming a generally V-shaped notch by drying the log to a desired moisture content, charring the log to a desired coloration, bathing the log in a protective solution, and drying the log. The slot is cut to a point less than or equal to the radius of the log. The charring of the log can be accomplished by the use of a blowtorch.

4 Claims, 2 Drawing Sheets

TREATMENT PROCESS FOR LOGS USED IN FURNITURE CONSTRUCTION AND FURNITURE COMPONENTS FORMED FROM SUCH TREATED LOGS

CROSS-REFERENCE TO RELATED U.S. APPLICATIONS

The present application is a continuation-in-part of U.S. application Ser. No. 11/932,999, filed on Oct. 31, 2007, entitled "TREATMENT PROCESS FOR LOGS USED IN FURNITURE CONSTRUCTION AND FURNITURE COMPONENTS FORMED FROM SUCH TREATED LOGS", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to furniture constructed from logs. More particularly, the present invention relates to a process for treating logs so as to prevent cracking 2. Description of Related Art Including Information Disclosed Under 37 CFR 1.97 and 37 CFR 1.98.

The use of logs to construct furniture is well known. As with the use of logs to create log homes, the use of logs in furniture is appealing both structurally and aesthetically. Throughout the world, many vendors sell articles of furniture constructed from logs of various types of woods. Log furniture can take the form of almost any type of furniture, from bedroom furniture sets to pool tables. Additionally, log furniture can be well suited for outdoor use, such as in patio furniture sets. Log furniture is often constructed by drilling a series of bolt holes through the logs. A series of bolts are threaded through the bolt holes and secured by nuts.

The use of various types of cedar logs to construct furniture is very common. White cedar, in particular, is preferred because it is very durable and naturally bacterial and fungal resistant. Cedar gives off organic compounds known as thujaplicins which contribute to the decay resistance. In addition, these organic compounds are responsible for the pleasant aroma of cedar and at the same time deter insects, moths and other pests. These properties also make cedar an appealing choice for products such as linen storage chests ("cedar chests") and shoe trees.

Over time, cedar logs undergo a natural process known as checking. During this process, moisture is released from the wood and longitudinal cracks form along the log. These cracks form across the annual growth rings of the logs but do not go through the center, or heart, of the log. While these cracks do not significantly affect the structural integrity of the logs, they are easily visible and make the furniture less aesthetically pleasing to some. Cracking can also occur as logs are subjected to the elements. Moisture from rain causes the logs to swell, and as they dry moisture is released and additional cracking can occur.

Although the integrity of the logs may not significantly be affected by checking or cracking, the integrity of furniture made from the logs may be. When cracks form in log furniture after the furniture has been assembled, they may interfere with the system of bolts used to secure the furniture together. If a crack encounters a bolt hole, it may cause the bolt to loosen. When the bolts loosen, the furniture, such as a chair, may become wobbly or collapse altogether.

Naturally, human beings and other animals tend to avoid placing themselves in situations where they feel their balance is compromised. For example, a patron in a restaurant will immediately want to switch chairs if the one they sit in is wobbly. Whether or not the patron fears that the chair will collapse under their weight is irrelevant. The wobbly chair is deemed unsuitable for its purpose. The same is true in the case of log furniture. If a piece of log furniture becomes wobbly, the consumer will become dissatisfied and feel the need to repair or replace the furniture even if it is not actually in danger of collapsing. The furniture can become wobbly due to the natural checking or due to cracking caused by exposure to the elements.

There are various methods for treating wood or lumber that are well known and commonly used in the industry. The goals of these treatments are to increase the durability of the wood and also to protect it from insects and fungus. Chemical preservatives are applied to the wood, often using pressure processes. These chemicals, in their concentrated forms, are often classified as toxic. Many of these chemicals are not readily available to the public and may require special permitting and approval for use. Some chemical preservatives, such as coal-tar creosote, may be brushed onto the wood. While modern treatment methods are relatively environmentally friendly, decades of wood treatment using older methods have contaminated ground water and soil with chemicals such as arsenic.

Many patents have issued which describe complex treatment processes for wood. For example, U.S. Pat. No. 3,968,276, issued on Jul. 6, 1976 to Allen, describes a process for the treatment of wood to impregnate the wood fully to its core with a resin component system, simultaneously with or without a flame retarding agent or preservative. The process involves enclosing the wood in a chamber, evacuating the chamber in a slow time cycle, adding a prepolymer aqueous solution to submerge the wood, continuing the vacuum, securing the vacuum, and applying pressure of prepolymer solution until the wood reaches the refusal point. In certain more dense woods, the vacuum and pressure cycles are repeated. The chemicals are purged and the chamber is evacuated. A final vacuum removes the residual surface liquids.

U.S. Pat. No. 5,075,131, issued on Dec. 24, 1991 to Hattori et al., teaches a method for preservation treatment of wood which comprises the steps of radiating a laser beam on a part of the surface of the wood at the least to form small holes therein, impregnating the wood with a preservative, and then applying high frequency waves to the wood to dry it by dielectric heating.

U.S. Pat. No. 5,943,789, issued on Aug. 31, 1999 to Yamamoto, describes an apparatus for treating green wood for the purpose of creating lumber of suitable quality for building construction. The wood is placed in a treatment chamber with a sealed atmosphere, the temperature of the chamber is increased, and the wood is maintained at a specific temperature and humidity for a given period of time, the wood is then sprayed with hot water until the moisture content of the wood decreases to a desired level.

Various patents have issued relating to the treatment of wood, specifically logs. For example, U.S. Pat. No. 4,233,753, issued on Nov. 18, 1980 to Olson, describes a method for treating whole logs to prevent them from splitting as they are dried to a desired moisture content. Whole green logs are placed in a pressure vessel which is sealed. Preferably the logs are debarked before they are placed in the vessel, but they may be debarked after their removal therefrom. Steam is thereafter injected into the vessel until the wood throughout the logs has reached a temperature within the range of about 190 to 240° Fahrenheit, while condensed water and other fluids from the wood are drained from the vessel. Subsequently the pressure in the vessel is released at a rate slow enough that no significant collapse of the wood within the logs occurs, and when the logs are cool enough to handle they are removed, debarked if necessary, and dried in a room whose relative humidity is maintained not less than about 45% until the logs have reached a predetermined moisture content.

U.S. Pat. No. 4,443,990, issued on Apr. 24, 1984 to Johnson, teaches a method of processing and producing crack free logs by making a saw cut along opposite longitudinal side portions of a log immediately after harvesting and thus curing the log, without debarking, in a shaded, ventilated air space so that any cracks will be concentrated along the saw cuts. When a finished appearance is desired, a groove is formed along the opposite side portions of the log in registry with the saw cuts and a spline or strip of wood is inserted in each groove so that it projects beyond the periphery of the leg with the spline or strip being secured in the grooves by glueing or the like. The peripheral or exterior portion of the spline or strips is peeled or cut off so that the resulting surface is contiguous with the peripheral surface of the log.

A typical manufacturer of log furniture may be a small company or a single craftsman with limited resources. Therefore, a need has developed for a process for treating logs used in furniture which does not require expensive tools or systems such as pressure vessels and controlled humidity chambers as found in the prior art. Additionally, there is a need for a treatment process which does not require many chemicals which may be harmful to the environment or which are not readily available to the public.

It is an object of the present invention to provide a log treatment process which makes logs crack-resistant.

It is another object of the present invention to provide a log treatment process which makes logs resistant to mildew, mold and weather stains.

It is another object of the present invention to provide a log treatment process which requires a minimal amount of special tools or machines.

It is still another object of the present invention to provide a log treatment process which uses a limited amount of chemicals.

It is a further object of the present invention to provide a log treatment process which is economically feasible for smaller manufacturers.

It is still a further object of the present invention to provide a log treatment process whereby the furniture constructed with the logs does not become wobbly.

These and other objects and advantages of the present invention will become apparent from a reading of the attached specification and appended claims

BRIEF SUMMARY OF THE INVENTION

The present invention is a process for treating a wooden log for use as a furniture component involving removing the bark from the log, cutting the log to a desired length, and planing the log to a desired shape. A longitudinal notch is cut towards the center of the log and along the length of the log. A generally V-shaped notch is formed by drying the log to a desired moisture content. The log is then charred to a desired coloration and bathed in a protective solution. The log is again dried and a varnish is applied to the log. The notch is cut to a depth less than or equal to the radius of the log. The log may be charred by applying heat from a propane torch onto the surface of the log. The moisture content may be approximately 10-11%.

A series of bolt holes are drilled in the log in desired locations. The holes may be formed through the notch on the log. The process also involves installing a bolt through the formed hole and fastening a nut to the bolt so as to secure the log to another article. Additionally, a hole is formed through another wooden log, a bolt is installed through the formed hole, a nut is passed through the hole formed through the other log and the nut is fastened to the bolt so as to secure the two logs together.

The present invention is also a log furniture assembly having crack-resistant properties which comprises a first log having a slot formed lengthwise along the first log. The slot opens (upon drying of the log) with a wide dimension at an outer surface of the first log. A second log is secured by a fastener to the first log. The second log also has a slot formed lengthwise along the log which opens (upon drying of the log) with a wide dimension at an outer surface of the second log. The first log has a hole formed thereon which extends into the slot. The second log also has a hole formed thereon. A bolt is affixed through the hole on the first log and through the hole on the second log. A nut is affixed to the bolt so as to secure the second log in a desired location relative to the first log. The nut is positioned interior of the second log away from the outer surface of the second log. Each of the first and second logs are charred to a desired coloration and have a protective coating extending thereover.

DETAILED DESCRIPTION OF THE INVENTION

Figure 1:
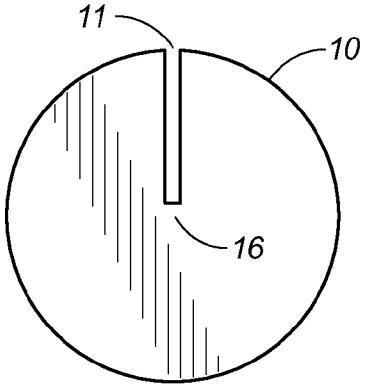
FIG. 1 is an end view of a log having a saw cut formed thereon.

The process of the present invention requires several steps. First, the bark on a log is removed. Then, the log is cut to a desired length appropriate for use as a furniture component. The log is then planed to obtain the desired shape. Next, a saw cut is formed longitudinally along the log. The saw cut is sliced radially toward the center of the log and may remove up to 45% of the diameter of the log. The saw cut does not extend past the center, or heart, of the log. The saw cut may be formed using a circular saw or more precisely by using more complex, specialized tools. Additionally, the saw cut runs the length of the log and opens at the ends of the log. During the natural process of checking, longitudinal cracks may form along the log which cross the annual growth rings of the log. These cracks do not extend past the center of the log. When a saw cut is formed in the log, stresses are relieved in the log and it is much less likely to form cracks elsewhere along the perimeter of the log.

After making the saw cut, the log is dried to a desired moisture content. Optimally, this moisture content is approximately 10-11%. The drying may be accomplished by placing the log in a hot, sunny area, or by other means such as the use of a blow-dryer type apparatus or a heated enclosure. The drying process causes the saw cut to open into a generally V-shaped notch. This process further reduces stresses within the log.

After drying, bolt holes may be drilled through the log at desired locations along the log for use during assembly of the furniture. These bolt holes may be in communication with the V-shaped notch formed in the log. This communication helps to better relieve the stresses of the log which ordinarily cause cracking or checking.

The next step in the process of the present invention is the charring step. The log may be charred using a typical propane blowtorch. The charring helps to further release stresses within the log by removing moisture from within the log. Additionally, the charring gives the log an enhanced aesthetic appearance. Darker spots will form along the natural imperfections of the wood, such as knots, and these spots give each log a unique appearance. The charring may be done by other means besides the typical propane blowtorch, however, the blowtorch is likely the simplest method for doing so since such torches can be found at most hardware and home improvement stores.

After charring, the log is dipped in a protective solution. This solution should serve to seal the log against the elements, and may be selected from a number of solutions well known in the art and readily available to the public. After being dipped in the protective solution, the log is again dried. Again, drying may be accomplished by placing the log in a hot, sunny area, or by other means such as the use of a blow-dryer type apparatus or a heated enclosure. After the log is dried, a varnish is applied. When the varnish is dry, the log is ready for use in the construction of log furniture. The treated log will be less likely to develop longitudinal cracks caused by the natural process of checking or by exposure to the elements. After the furniture is put into use, it may be helpful to apply additional varnish from time to time to further protect the logs from the elements.

Figure 3:
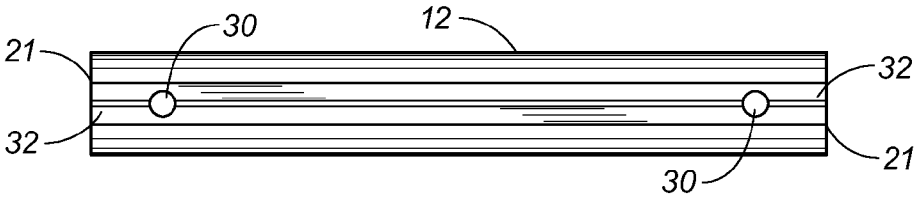
FIG. 3 is a side view of a log used as a furniture component treated using the process of the present invention.
Figure 4:
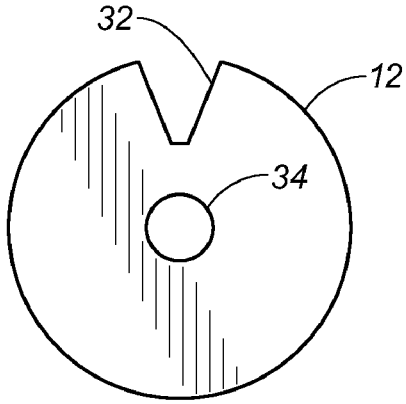
FIG. 4 is an end view of a log used as a furniture component treated using the process of the present invention.

FIG. 1 is an end view of a log 10 having a saw cut 11 formed thereon. The saw cut 11 extends along the length of the log 10 and towards the center 16 of the log 10. The saw cut 11 could be made shallower, but should not extend deeper than the center 16 of the log 10. The saw cut 11 is made before the log 10 is dried to a desired moisture content. The drying step causes the saw cut 11 to open to a generally V-shaped notch as shown in FIGS. 2-4.

Figure 2:
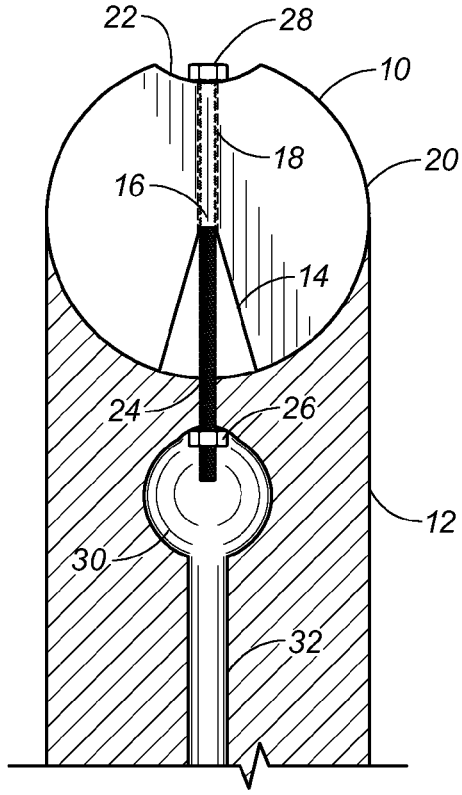
FIG. 2 is an end view of a treated log used as a furniture component connected to another treated log.

FIG. 2 is an end view of a treated log 10 used as a furniture component connected to a second log 12. The generally V-shaped notch 14 is shown extending towards the center 16 of the log 10. The notch 14 is shown as having removed approximately one eighth of the outer circumference 20 of the log 10. The notch 14 could remove more or less of the outer circumference 20, but should not remove more than 45% of the circumference 20.

A bolt hole 18 is formed through the log 10. An indentation 22 is formed on the log 10 so that a head 28 of the bolt 24 can rest at or below the surface of the log 10. The bolt hole 18 is shown as being in communication with the notch 14.

The first log 10 is connected to the second log 12 by bolt 24 and nut 26. The nut 26 is threadedly connected to the bolt 24. The head 28 of the bolt 24 rests in the indentation 22 of the first log 10. A bolt access hole 30 is formed in the side of the second log 12 and extends far enough therein so as to facilitate the connection of the nut 26 to the bolt 24. The bolt access hole 30 is in communication with the V-shaped notch 32 formed on the second log 12.

For clarification, the bolt 24 extends from the indentation 22, through the bolt hole 18 and into the V-shaped notch 14 of the first log 10. From there, the bolt 24 extends into a bolt hole drilled in the second log 12. The end of the bolt 24 then extends into the bolt access hole 30, where a nut 26 is attached, securing the logs together.

FIG. 3 shows a side view of the second log 12. As shown, the generally V-shaped notch 32 extends the entire length of the log 12, opening at the ends 21. There are shown two bolt access holes 30 near each end. These bolt access holes 30 may be drilled at any point along the log 12 so as to connect to other logs in a desired fashion. Also, additional bolt holes, bolt access holes, or indentations may be formed within the notch 32 or at other locations to allow for seating of a bolt head or for the attachment of a nut.

FIG. 4 shows an end view of the second log 12. The bolt 24 shown in FIG. 2 (not shown here), would pass from the V-shaped notch 14 of the first log 10, into the bolt hole 34 of the second log 12. Also shown here is the V-shaped notch 32 of the second log 12.

Figure 5:
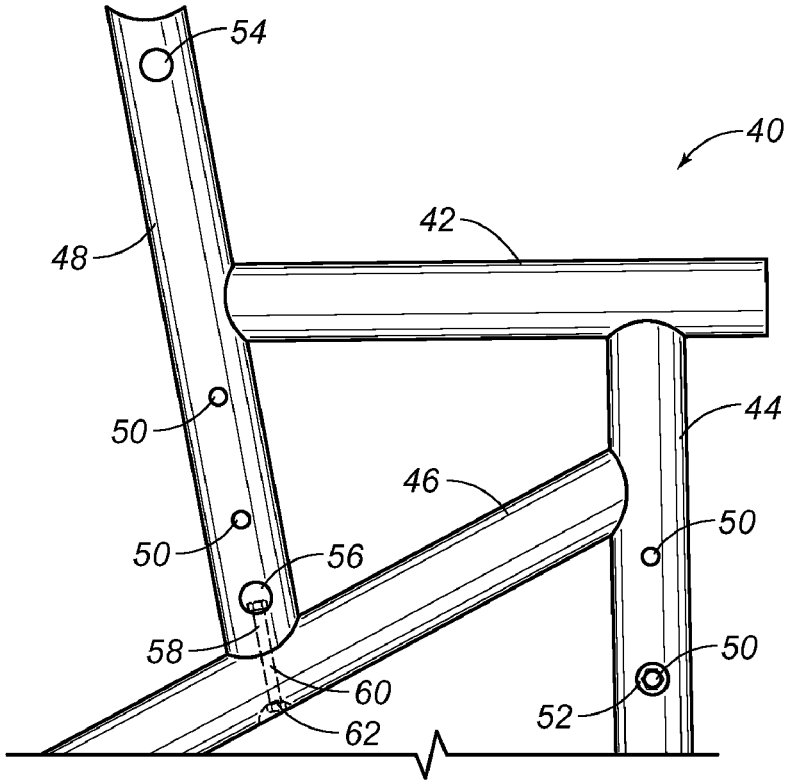
FIG. 5 a side view of a furniture component assembled with treated logs of the present invention.

FIG. 5 shows a furniture component 40 formed of treated logs 42, 44, 46, and 48. The logs have been cut to desired lengths and treated. Three different types of holes are shown on the component 40. In this case, the component 40 is an end or side section of a log chair.

A series of bolt holes 50 are shown drilled through the logs. An indentation 52 is also shown formed on the log 44. Indentation 52 allows for a head of a bolt to rest below the surface of the log 44 when inserted into the associated bolt hole 50. Two bolt access holes 54 and 56 are shown formed on the log 48. The access holes 54 and 56 allow a person assembling the furniture to affix a nut on an end of a bolt inserted through a bolt hole. For example, in order to secure logs 46 and 48 together, a bolt would be threaded through bolt holes 60 and 58 (indicated by dashed lines). The head of the bolt would rest in indentation 62, while the end of the bolt would extend into bolt access hole 56. A nut would then be secured on the bolt through bolt access hole 56. The V-shaped notches are not seen in FIG. 5, as the logs are arranged such that they do not face the outer sides of the furniture, creating a more aesthetically pleasing appearance.

The foregoing disclosure and description of the invention is illustrative and explanatory thereof. Various changes in the details of the illustrated construction can be made within the scope of the present claims without departing from the true spirit of the invention. The present invention should only be limited by the following claims and their legal equivalents.

I claim:

1. A process for forming a furniture component comprising:

removing bark from a log;

cutting said log to a desired length;

planing said log to a desired shape;

cutting a longitudinal slot towards a center of said log and along a length of said log;

forming a generally V-shaped notch by drying said log to a desired moisture content;

charring said log to a desired coloration;

bathing said log in a protective solution;

drying said log;

applying a varnish to said log;

drilling a series of holes through said V-shaped notch in said log in desired location;

forming a first hole into an end of another wooden log;

forming a second hole in said another wooden log such that said second hole intersects said first hole;

installing a bolt through the drilled hole such that said bolt extends through the formed first hole in said another log;

passing a nut through the formed second hole in said another log; and fastening said nut to said bolt so as to secure said log to said another wooden log.

2. The process of claim 1, said step of cutting comprising cutting said slot to a depth less than or equal to a radius of the log.

3. The process of claim 1, said step of charring comprising applying heat from a torch onto a surface of said log.

4. The process of claim 1, said moisture content being approximately 10 to 11%.

* * * * *